US008235236B2

(12) United States Patent
Zuares et al.

(10) Patent No.: US 8,235,236 B2
(45) **Date of Patent: *Aug. 7, 2012**

(54) DRINKING CUP LID HAVING A PLUG ATTACHED WITH TWO ARMS

(76) Inventors: Daniel J. Zuares, Rockville, MD (US); Robert M. Schwartz, Miami, FL (US); Tony Licari, Davie, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/150,377

(22) Filed: Jun. 1, 2011

(65) Prior Publication Data

US 2011/0226769 A1 Sep. 22, 2011

Related U.S. Application Data

(63) Continuation of application No. 11/562,781, filed on Nov. 22, 2006, now Pat. No. 7,954,659.

(60) Provisional application No. 60/824,520, filed on Sep. 5, 2006, provisional application No. 60/739,525, filed on Nov. 23, 2005.

(51) Int. Cl.
*B65D 51/18* (2006.01)
*B65D 55/16* (2006.01)

(52) U.S. Cl. ..... 220/254.7; 220/254.3; 220/259.1; 220/374; 220/375; 220/713; 220/715; 220/719; 222/109; 222/558

(58) Field of Classification Search ..... 215/306, 215/387, 389; 220/203.13, 203.14, 212, 220/212.5, 253, 254.3–254.7, 256.1, 259.1, 220/314, 367.1, 368, 369, 373–375, 711, 220/713–719, 728, 730, 756, 833, 834; 222/108–111, 454, 456, 482, 543, 545–548, 222/554, 556, 558, 563
See application file for complete search history.

(56) References Cited

U.S. PATENT DOCUMENTS

| | | | |
|---|---|---|---|
| 2,608,841 | A | 9/1952 | Rice |
| 2,764,199 | A | 9/1956 | Tupper |
| 3,005,571 | A | 10/1961 | Hugh |
| 3,016,168 | A | 1/1962 | Larson |
| 3,031,111 | A | 4/1962 | Stull |
| 3,357,605 | A | 12/1967 | Chadfield |
| 3,419,198 | A | 12/1968 | Pettersen |
| 3,587,944 | A | 6/1971 | Pehr |
| 3,744,662 | A | 7/1973 | Zundel |
| 3,806,023 | A | 4/1974 | Barnett |
| 3,905,512 | A | 9/1975 | Albert et al. |
| 3,990,598 | A | 11/1976 | Zapp et al. |
| 4,127,221 | A | 11/1978 | Vere |
| 4,130,215 | A | 12/1978 | Corey et al. |
| 4,184,603 | A | 1/1980 | Hamilton, Sr. |
| 4,190,173 | A | 2/1980 | Mason et al. |
| 4,331,255 | A | 5/1982 | Fournier |
| 4,357,042 | A | 11/1982 | Gall |
| 4,388,996 | A | 6/1983 | Panicci |
| 4,394,928 | A | 7/1983 | Philip |
| 4,420,092 | A | 12/1983 | Finkelstein |
| 4,449,640 | A | 5/1984 | Finkelstein |
| 4,462,504 | A | 7/1984 | Roth et al. |

(Continued)

*Primary Examiner* — J. Gregory Pickett
*Assistant Examiner* — Ned A Walker
(74) *Attorney, Agent, or Firm* — Robert M. Schwartz

(57) ABSTRACT

A cup lid for attachment to a disposable drinking cup having a center portion with an opening therein, a peripheral edge surrounding the center portion for engaging the drinking cup, a plug disposed outside the peripheral edge of the cup lid and connected to the peripheral edge of the cup by two flexible support arms for allowing the plug to be repositioned at the opening.

10 Claims, 9 Drawing Sheets

U.S. PATENT DOCUMENTS 4,463,866 A 8/1984 Mandel
4,503,992 A 3/1985 Sitko et al.
4,586,622 A 5/1986 Waldorf
4,754,895 A 7/1988 Lardner et al.
4,779,766 A 10/1988 Kinsley
4,874,103 A 10/1989 Quisenberry et al.
4,899,902 A 2/1990 DeMars
4,949,865 A 8/1990 Turner
4,953,743 A 9/1990 Dart et al.
5,027,973 A 7/1991 Drogos
5,199,618 A 4/1993 Reil et al.
5,200,153 A 4/1993 Carr et al.
5,409,112 A 4/1995 Sagstetter
5,409,113 A 4/1995 Richardson et al.
5,490,609 A 2/1996 Lane et al.
5,495,941 A 3/1996 Leonard
5,538,156 A 7/1996 Proshan
5,542,670 A 8/1996 Morano
5,662,245 A 9/1997 Grant
5,711,463 A 1/1998 Chen et al.
5,749,491 A 5/1998 Wylder et al.
5,873,493 A 2/1999 Robinson
5,992,677 A 11/1999 Ebine
6,062,001 A 5/2000 Kunik
6,126,035 A 10/2000 Schaper et al.
6,176,390 B1 1/2001 Kemp
6,220,476 B1 4/2001 Waller
6,305,571 B1 10/2001 Chu
6,315,145 B1 11/2001 Fask et al.
6,318,584 B1 11/2001 Milan
6,382,476 B1 5/2002 Randall et al.
6,431,390 B1 8/2002 Waller
6,488,173 B2 12/2002 Milan
D480,968 S 10/2003 Atkins et al.
6,644,490 B2 11/2003 Clarke
6,679,397 B2 1/2004 Smith et al.
6,702,145 B2 3/2004 Malcolm
6,811,049 B2 11/2004 Lukacevic
6,824,003 B1 11/2004 Wong
6,905,044 B1 6/2005 Russo et al.
6,932,231 B2 8/2005 Haynes et al.
7,063,224 B2 6/2006 Clarke et al.
7,131,551 B2 11/2006 Smith
7,134,566 B2 11/2006 Smith et al.
7,175,042 B2 2/2007 Durdon
7,568,591 B2 8/2009 Tedford, Jr.
2002/0011494 A1 1/2002 Lukacevic
2002/0038803 A1 4/2002 Malcolm
2002/0053569 A1 5/2002 Mills et al.
2003/0089714 A1 5/2003 Dart et al.
2004/0060934 A1 4/2004 Haynes et al.
2004/0232154 A1 11/2004 Smith et al.
2004/0256386 A1 12/2004 LaFortune
2005/0082290 A1 4/2005 Fask et al.
2006/0005369 A1 1/2006 MacKenzie et al.
2006/0255043 A1 11/2006 Tedford
2007/0039960 A1 2/2007 Pawlik
2007/0068943 A1 3/2007 Ramsey et al.
2008/0105696 A1 5/2008 Dart et al.
2008/0110887 A1 5/2008 Ramsey et al.
2008/0173654 A1 7/2008 Hakim

DRINKING CUP LID HAVING A PLUG ATTACHED WITH TWO ARMS

INDEX TO RELATED APPLICATIONS

This application is a continuation of U.S. patent application Ser. No. 11/562,781, filed Nov. 22, 2006 and also claims the benefit of U.S. Provisional Patent Application Serial No. U.S. 60/739,525 entitled NON-SPILLABLE CUP LID FOR CONTAINER, filed Nov. 23, 2005 and U.S. Provisional Patent Application Ser. No. 60/824,520 entitled BEVERAGE LID HAVING AN INSERTABLE PLUG ATTACHED TO SAID LID filed Sep. 5, 2006 the disclosures of which are incorporated herein by reference in their entirety.

BACKGROUND OF THE INVENTION

1. Field of Invention

The present invention relates to a removable lid for a cup. The lid being especially suited for disposable cups, to fit tightly over the top opening of a cup, which typically contains coffee or other beverages. The lid of the present invention is intended to limit and prevent unwanted spillage of the contents of the cup while allowing the user to drink the contents while the lid remains on the cup.

The present lid being simple and inexpensive to manufacture, competitive with cup lids without splash-proof capabilities.

2. Art Related to the Invention

Splash-proof lids for drinking cups to prevent unwanted loss or spillage of the contents of the cup that occurs when the cup is unintentionally moved are well known. Splash-proof cup lids with baffles are disclosed in prior patents including U.S. Pat. Nos. 6,488,173 and 6,305,571. However, these disclosed lids require multiple steps of assembly, are not unitary lids and thus are expensive, complicated to assemble and manufacture, and do not solve the problems addressed by the present invention.

Another example of a splash-proof lid is described in U.S. Pat. No. 6,811,049, which discloses a one-step molding process for forming a lid, whereby a chamber is created by rotating a bottom lid section against the underside of the lid. However, to form the chamber, an edge of the bottom lid section must mate with the circumferential snap-fitting portion of the lid. Not only is the chamber not sealed, but the integrity of the snap-fitting relationship between the cup and underside of the lids is interrupted, allowing for leaks. A preferred embodiment requires the bottom lid section must snap to the underside of the lid. The lid does not mate as a unitary layer with the cup along the entire snap-fitting portion and therefore compromises the integrity of the seal between the lid and the cup.

U.S. Patent Application Publication No. US 2006/0005369, discloses a cup lid with two snap together pieces to form a removable plug. This apparatus is expansive to assemble and manufacture, and, likewise, does not solve the problems addressed by the present invention.

A well-known method of manufacturing cup lids of the type used for coffee to-go cups and soft drinks is by vacuum forming, a plastic thermoforming process that involves forming thermoplastic sheets into three-dimensional shapes through the application of heat and pressure. This vacuum forming allows cup lids to be manufactured very inexpensively, provided the lid can fit within a clamshell type molding system. In general terms, vacuum forming refers to sheet forming methods, including drape forming, which is one of the most popular. Basically during vacuum forming processes, plastic material is heated until it becomes pliable, and then it is placed over a mold and drawn in by a vacuum until it takes on the desired shape. Vacuum thermoforming is used for producing plastic parts that have sharp details, close mold tolerances and fit to specific products.

As well know in the art, during the vacuum forming process, a sheet of heated plastic material is placed over a male or female mold. The mold then moves towards the sheet and presses against it to create a seal. Next, the application of a vacuum draws out the air between the mold and the sheet so that the plastic conforms to the mold exactly. When the curing temperature is reached and the piece is formed, air blows back into the mold and separates the new part from the mold. This process resembles the two potions of a clamshell that close upon one another. Articles suitable for this process must be formed of a single piece so that only one close and open sequence is required to completely form the article.

An advantage of the vacuum forming process is that plastic parts can be made with close mold tolerances and details for friction-fit assembly. Sharp, precise detail is available for many products, which makes vacuum formed plastics an attractive alternative to other molding processes.

There is a need for a simplified splash-proof lid, which can function with a conventional disposable cup, which is easy and inexpensive to manufacture, stack, ship, easy to use, and aesthetically pleasing to a user.

Therefore, it is an object of the present invention that a unitary lid be manufactured by vacuum form process or similar process that is inexpensive to make.

It is another object of the present invention that a splash-proof lid have a chamber in fluid communication with a drinking hole and the interior of the cup. It is another object of the present invention that the peripheral edge of the lid be in continuous contact with the cup edge.

It is an object of the present invention that the lid be a single or unitary piece that does not require assembly.

It is another object of the present invention that the lid may be made by any of the manufacturing processes known in the art.

It is another object of the present invention that the lid be manufacturable with a clamshell mold system.

It is another object of the present invention that the lid be disposable.

It is another object of the present invention that the lid be re-closeable.

It is another object of the present invention that the lid be non-disposable.

It is another object of the present invention that the lid be airtight.

It is another object of the present invention that the closing means be removable after placement in the well.

It is another object of the present invention that the lid seal on the cup and be drip free.

It is another object of the present invention that the lid seal on peripheral edges of the top of the cup.

It is another object of the present invention that a plug be detachable for insertion in a well to form a chamber.

BRIEF SUMMARY OF THE INVENTION

The present invention is an improvement in manufactured lids, which includes a sealing plug with or without an opening, sized to preferable be pressed into a drink opening or recess where the sealing plug is connected to the cup lid by a hinge that does not require assembly of the sealing plug to the cup lid.

In one embodiment of the present invention provides for A unitary lid for a drinking cup comprising:

(a) a circular disc having a single layer snap-fitting periphery for engagement with a cup rim;

(b) a drinking hole positioned in said disc adjacent said snap-fitting periphery of said disc;

(c) a closing means or closure attachment forming a part of said unitary lid; and (d) a chamber formed within said unitary disc, said chamber having a bottom chamber portion and an upper portion formed by the vertical sides of said chamber and lower portion which extends below the horizontal plane of said disc, said chamber having at least one inlet formed in the bottom chamber portion. When said plug also comprises an exit hole, the hole in the chamber is not in vertical alignment with the drinking hole on the plug.

As described in the present invention, a unitary lid refers to a configuration by which the manufactured article comprises a single contiguous piece.

The lid of the present invention comprises a plug positioned on the peripheral edge of a cup lid for rotatable engagement on the upper side of the lid within a well to form a chamber. The inner circumference of the wall acts as a receiver for the plug, and the plug and well engage with a snap-fit relationship.

In one embodiment, the lid of the present invention provides for a closing means that is rotatably attached to said disc along said snap periphery of said disc. In a preferred embodiment, the closing means or closure attachment is attached to support arms that rotate into position to engage the closing means or closure attachment with the engagement means on the lid. Optionally, these support arms may further include indentations along either the upper, lower, or both horizontal surfaces that serves as a pinch point. The pinch point in the present invention provides a point at which the support arms form an angular vertex allowing for closure of the plug into the engaging means. The pinch point is not required to practice all embodiments of the present invention, most preferred, the closing means or closure attachment engages the engaging means on the upper surface of the lid. To engage the closing means, the user rotates the closing means or closure attachment and positions the closing means or closure attachment such that it engages the receiving means in a snap-fit relationship.

In a preferred embodiment, the closing means or closure attachment comprises a plug that rotates with support arms that are a unitary part of said unitary lid to engage with said closing means or closure attachment on the upper surface of said lid.

In one embodiment, the lid of the present invention interacts with the edge of a cup to form a friction seal. The friction seal of the present invention provides a better seal than other attempts because the entire circumference is sealed with a single layer of material on the underside of the lid in direct and contiguous contact with the upper edge of the cup.

In one embodiment, a plug may further include a drinking hole incorporated onto the surface of the plug that will be the upper surface when the plug is engaged with the closing means.

In an alternative embodiment, the plug is a unitary part of the cup lid that is attached to the lid in a manner that it may be readily detached and placed in position to interact with the engagement means to effectuate closure of a drinking hole.

In a further embodiment, a chamber comprises a top chamber portion that is formed in said disc and has an upper portion that is coplanar with the horizontal upper planer surface on the upper portion of the lid. The chamber has an inlet that is in either the sidewall or bottom wall of the chamber portion.

Further, there may be two or more inlets formed in said chamber portion. The size of the chamber may also be varied (e.g. made larger or smaller depending on preference).

The bottom chamber portion may be peaked at its center and slanted downward towards said end walls and further may be shaped as an arcuate tube, concentric with said arcuate side of said bottom lid section.

Further contemplated in the present invention is the ability for numerous lids to interconnect so they nest in one another in a stacking arrangement and are easily packed and shipped in bulk.

DETAILED DESCRIPTION OF THE PREFERRED EMBODIMENTS

Figure 1:
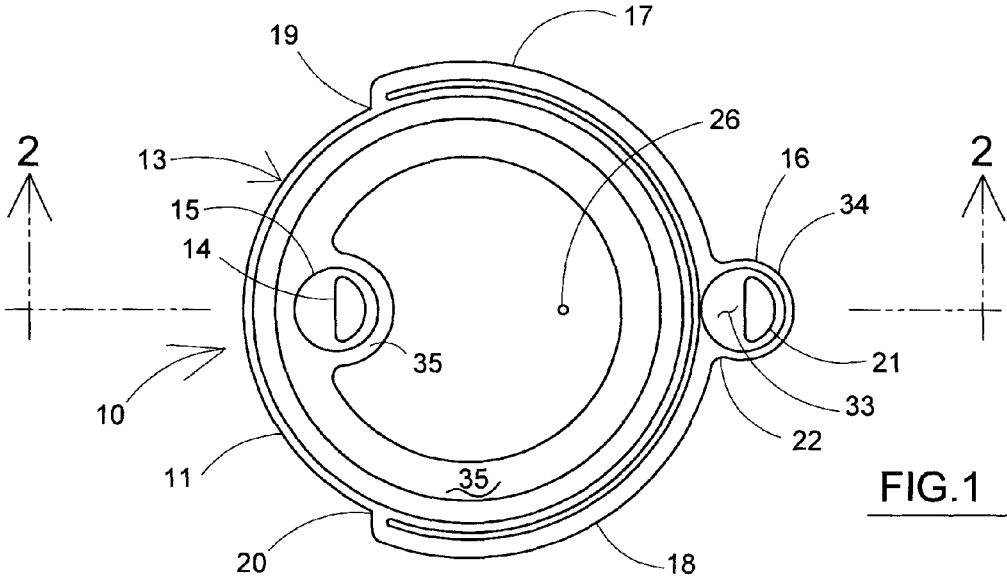
FIG. 1 is a top view of the cup lid of the present invention.

The unitary splash-proof beverage lid 10 of the present invention is illustrated in FIG. 1. Cup lid 10 comprises a disc 11, having a center portion 12, a peripheral edge area 13, a first fluid opening 14, and a well 15. A plug 16 is formed as a unitary part of cup lid 10 and is connected to disc 11 by a pair of support arms 17 and 18, at the peripheral edge 13 of disc 11. First arm 17 is connected to edge 13 at pivot 19 and second arm 18 is connected to edge 13 at pivot 20. Arms 17 and 18 are flexible, concentric, and spaced apart, from peripheral edge 13. Plug 16 is rotateable at pivots 19 and 20 relative to disc 11. Plug 16 has a second fluid opening 21 and is connected to said arms 17 and 18 at neck 22.

Figure 2:
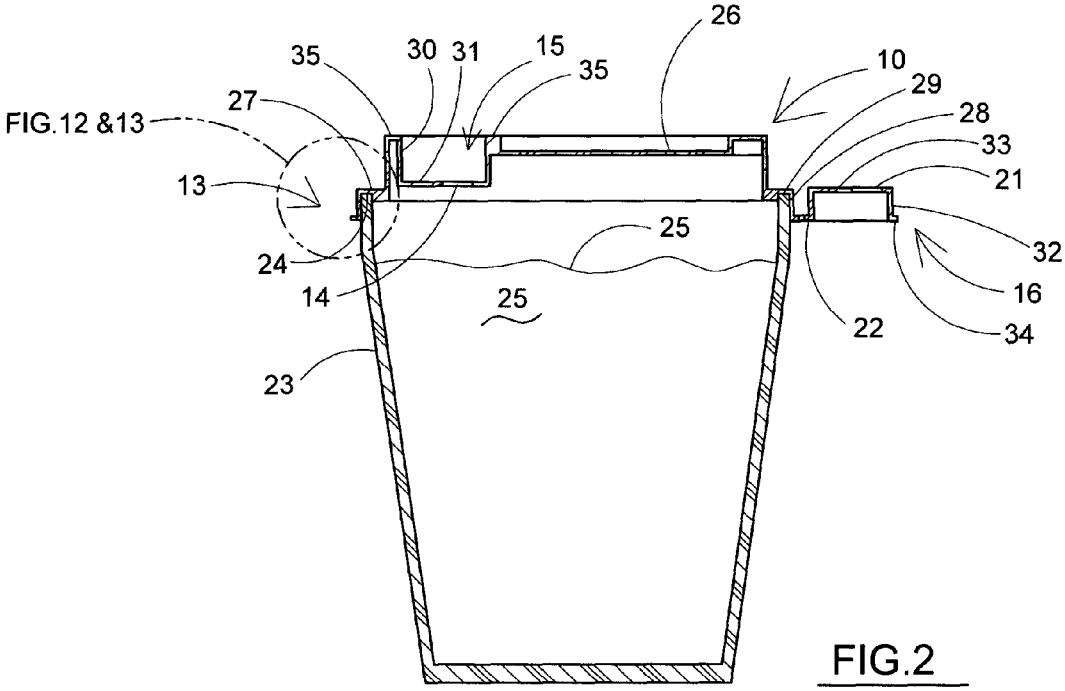
FIG. 2 is a sectional view of the cup lid of the present invention mounted on a cup, along section lines 2-2 of FIG. 1, with the closure means in an open position.
Figure 3:
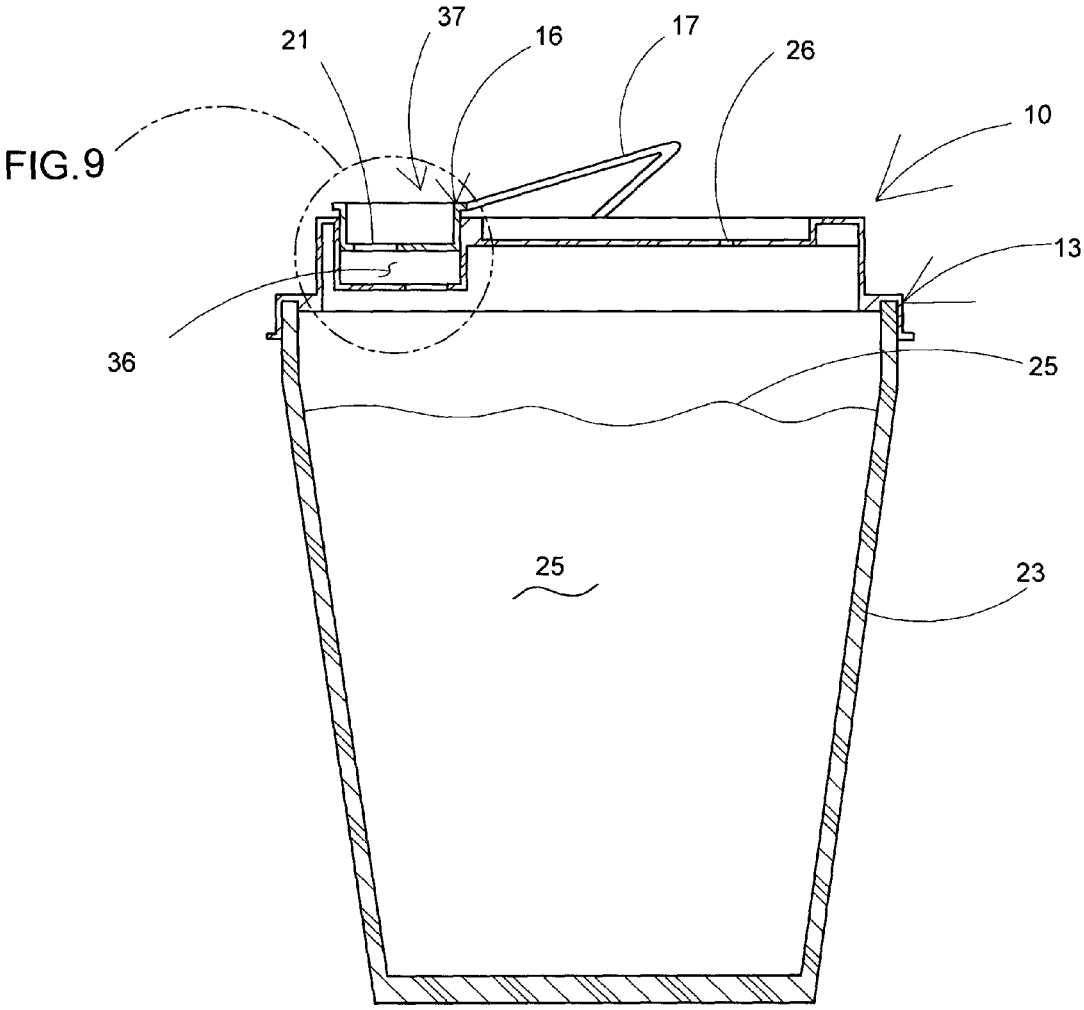
FIG. 3 is a sectional view of the cup lid of the present invention mounted on a cup, along section lines 2-2 of FIG. 1, but shown with the closure means in a closed position forming a chamber.

As seen in FIGS. 2 and 3 cup lid 10 is mounted on a cup 23 (shown in FIG. 2 as a partial cup). Disc 11 fits on cup 23 in a snap-fitting peripheral arrangement, such that lid 10 is in constant uninterrupted contact with the top circumferential edge 24 of cup 23. Cup 23 may be at least partially filled with liquid 25. Lid 10 has an air vent opening 26.

Figure 12:
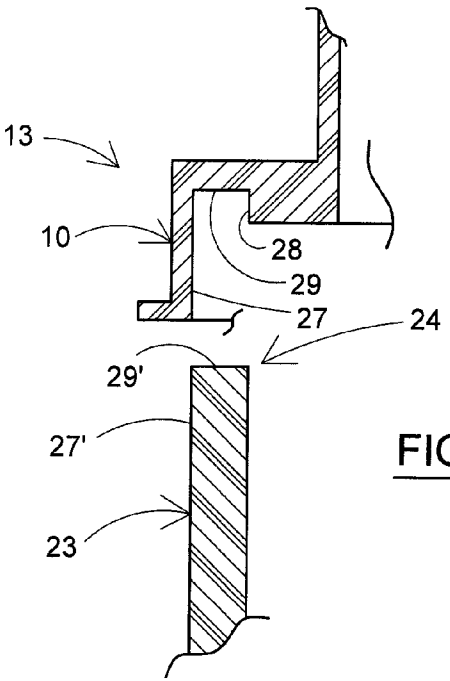
FIG. 12 is an exploded schematic drawing view from FIG. 2 of the relationship of the peripheral edge 13 and cup 23.
Figure 13:
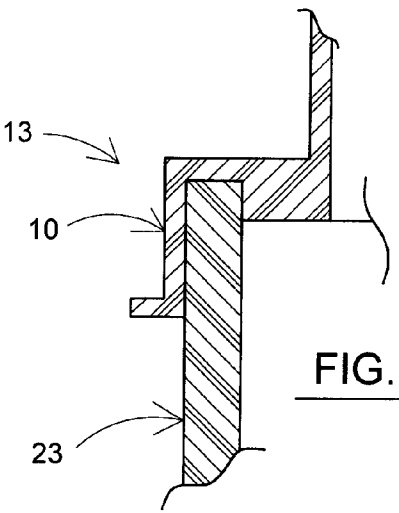
FIG. 13 is an enlarged schematic drawing view from FIG. 2 of the relationship of the peripheral edge 13 and cup 23.

The underside of peripheral edge 13 is constructed and arranged to releasably attach to the upper circumferential edge 24 of cup 23. FIGS. 12 and 13 are sectional views of the arrangement of lid 10 and cup 23. Lid 10 is releasably attached to cup 23 with a snap-fit, or friction-fit, type of mechanical engagement. Lid 10 has underside outer vertical wall 27, underside interior vertical wall 28, and underside interior horizontal wall 29 that interact as a single contiguous contact surface with top circumferential portion of cup 23. Said walls 27, 28, and 29 interact with the outside top wall 27', inside top wall 28' and top edge 29' respectively of cup 23, to make the snap-fit/friction fit.

Figure 9:
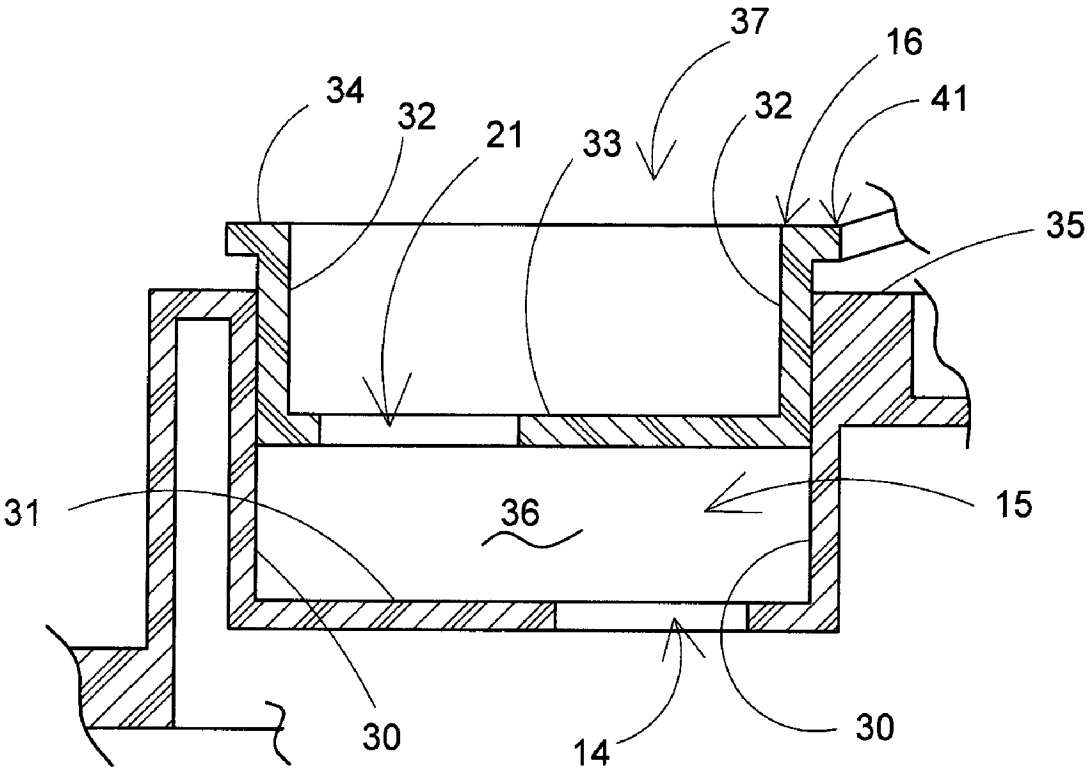
FIG. 9 is an enlarged schematic drawing of chamber 36 generally taken from FIG. 3.

As seen in FIG. 9, well 15 has an interior vertical circumferential wall 30 and a floor wall surface 31. Said floor 31 has an opening previously identified as first fluid opening 14 to allow flow of liquid 25 through lid 10 when cup 10 is tilted for drinking purposes. Plug 16 has circumferential sidewall 32, a floor wall surface 33, and a circumferential lip 34.

The height of interior circumferential wall 30 extends from floor 31 to a circumferential drinking edge 35 of lid 10. The height of circumferential sidewall 32 of plug 16 extends from floor 31 to circumferential lip 34.

Plug 16 is constructed and arranged to fit within well 15 with a friction-fit or a snap-fit type of mechanical engagement. Preferably plug 16 will be releasable from well 15 though it may also be desirable to have plug 16 permanently fit or permanently snap within well 15.

It is preferable that circumferential lip 34 contact circumferential drinking ledge 35 to form a smooth upper drinking surface 41 which would include drinking ledge 35 and lip 34.

Circumferential wall 30 of well 15 is constructed and arranged to be of greater height than the height of circumferential sidewall 32 of plug 16, such that a chamber 36 is formed when plug 16 is inserted into well 15.

Chamber 36 is formed by the lower portion of circumferential wall 30 (below plug 16), the top of floor wall 31, and the bottom of floor wall 33. As can be seen in FIGS. 3 and 9, there is fluid communication between the interior of cup 23 through first drinking hole 14, through chamber 36, and through second drinking hole 21. Chamber 36, may include an air vent to atmosphere (not shown) in floor wall 31 or fall wall 33, or to the interior of cup 23 in sidewall 30.

Referring to FIG. 3, when plug 16 is placed within well 15, a second well, drinking well 37 is formed. The depth of drinking well 37 equal to the height of circumferential wall 32. Preferably the depth of well 37 will be as shallow as possible and chamber 36 will be correspondingly larger. The variable for altering the chamber 36 size during the manufacturing process will be to increase the height of wall 30 and decrease the height of wall 32.

Well 15, plug 16 and chamber 36 interact. The chamber 16 thus can be of any size shape—subject to the interrelationships and other outside forces, as long as the circumferential wall 32 of plug 16 can sufficiently engage the circumferential wall 30 of well 15 in a frictional-fit/snap-fit relationship.

Figure 4:
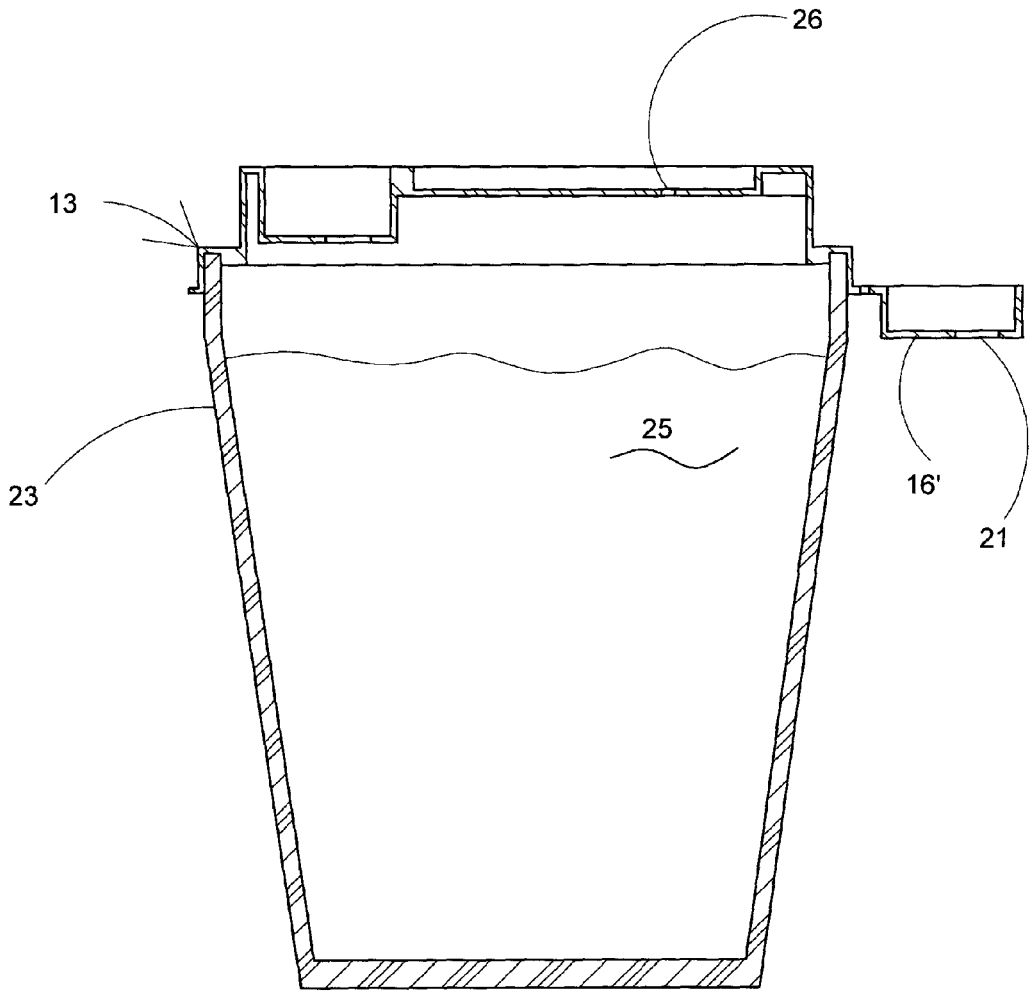
FIG. 4, an alternate embodiment, is a sectional view of the cup lid similar to FIG. 2, with the closure means in the open position.
Figure 5:
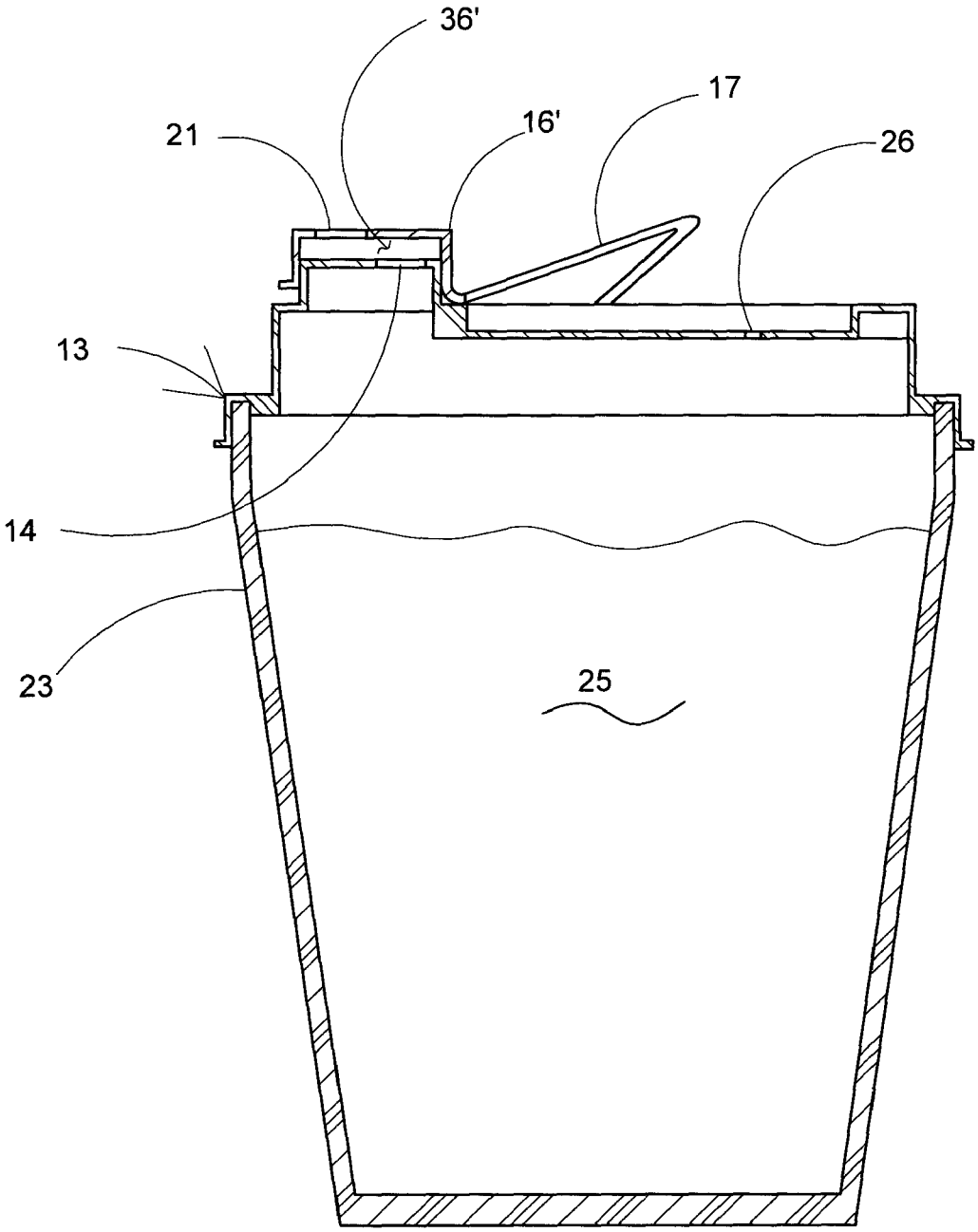
FIG. 5 the alternate embodiment of FIG. 4, is shown in a sectional view of the cup lid, with the closure means in the closed position.

An alternate embodiment is shown in FIGS. 4 and 5. In this embodiment the well 15' and plug 16' have been inverted. They still interact to form a chamber 36'.

Figure 6:
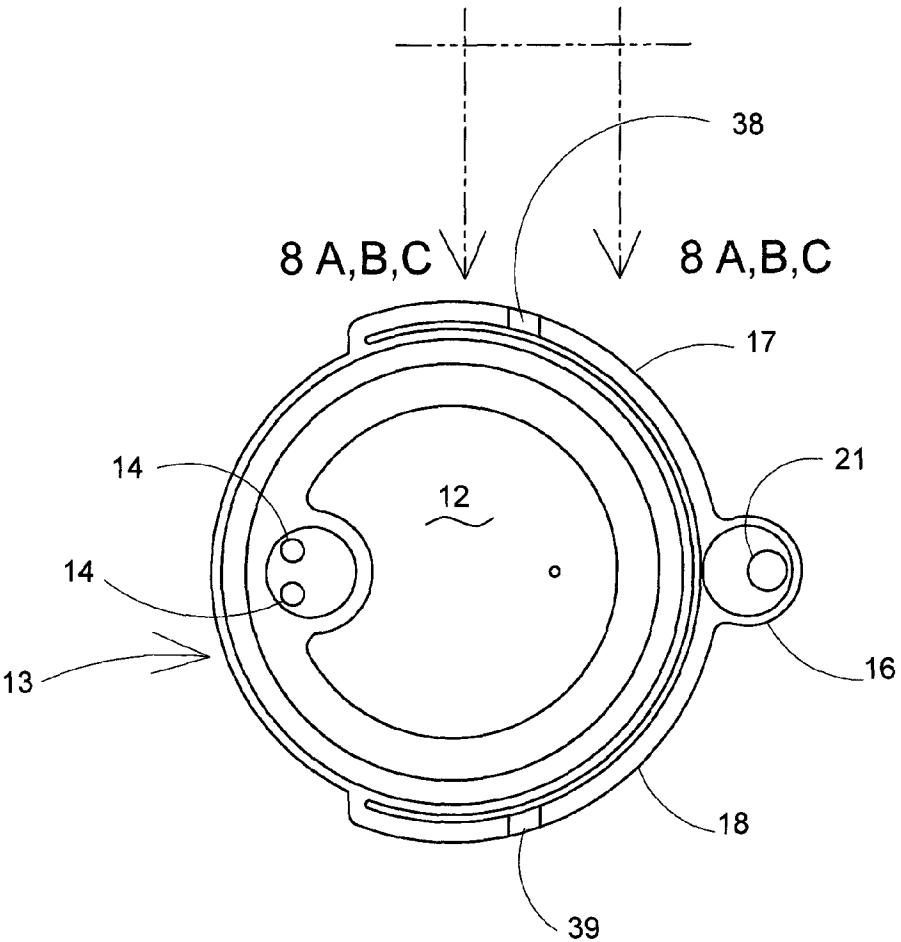
FIG. 6 is a top view of another alternate embodiment whereby the fluid openings are circular, the well has two openings in a different location and arms shown with pinch points.

Other alternate embodiments are shown in FIG. 6, with two first fluid openings 14 in a different shape, round, and in alternate locations closer to the peripheral edge 13 of lid 10. Also, second fluid opening 21 is of a round shape. Said fluid openings 14 and 21 can be of a variety of shapes and sizes and can be in various locations to provide fluid communication from within cup 23 through openings 14 and 21 of chamber 36. Additionally, arms 17 and 18 may have pinch points 38 and 39.

Figure 7:
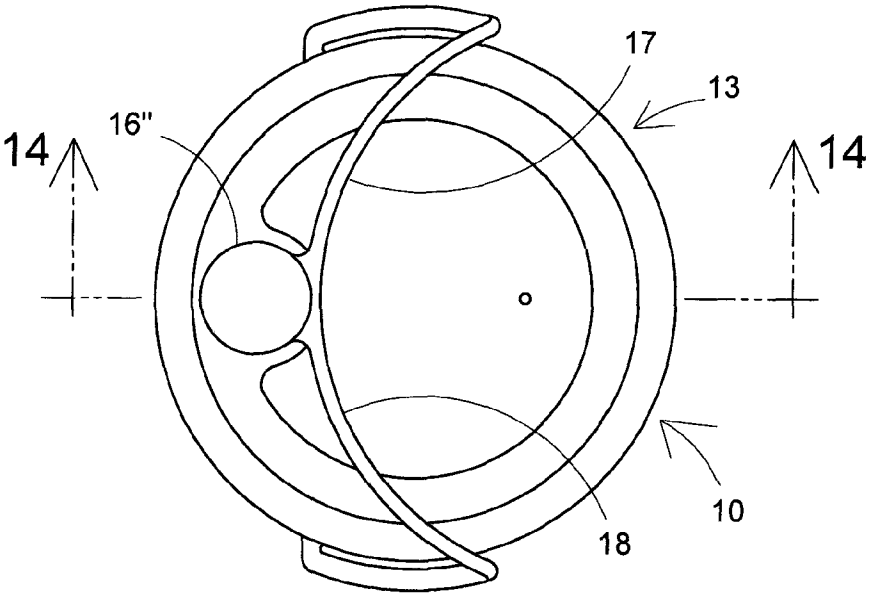
FIG. 7 a top view of another alternate embodiment with the closure means in a closed position and no opening in the closure means.

As seen in FIGS. 3, 5, and 7, when plug 16 is rotated to engage well 15, arms 17 and 18 flex accordingly in a bow fashion. Referring to FIG. 6, pinch point 38 on arm 17 and pinch point 39 on arm 18 will result in less flexing of arms 17 and 18, in the rotated position. With the pinch points 38 and 39, arms 17 and 18 will fold in a flatter position, such that said arms 17 and 18 in the folded position will be closer to lid 10. Pinch points 38 and 39 are made during the manufacturing process, and it is well known in the art, to weaken a point such that said weakened point will form an angular vertex upon application of force to create a fold in said arms 17 and 18.

Figure 8A:
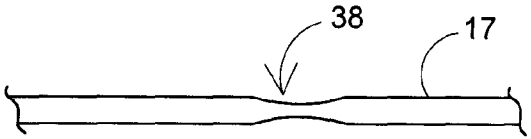
FIG. 8A a side view of the support arm shown in FIG. 6. from lines 8A,B,C-8A,B,C showing a pinch point congruent on both surfaces.
Figure 8B:
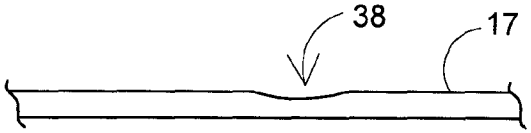
FIG. 8B a side view of the support arm shown in FIG. 6. from lines 8A,B,C-8A,B,C showing an alternative pinch point on one surface.
Figure 8C:
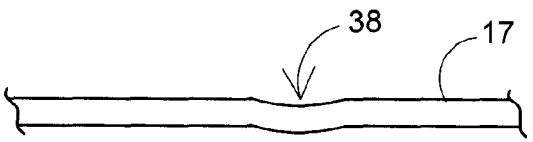
FIG. 8C a side view of the support arm in FIG. 6. from lines 8A,B,C-8A,B,C showing another alternative pinch point that is convex on both surfaces.

FIG. 8 is a side view of three possible embodiments of the pinch point 38 on support arm 17. There may be a single indentation on only one horizontal surface, complementary, congruent indentations on each of the upper and lower horizontal surface of support arm 17, or convex indentations opposite each other on both the upper and lower horizontal surfaces of support arm 17.

Figure 14:
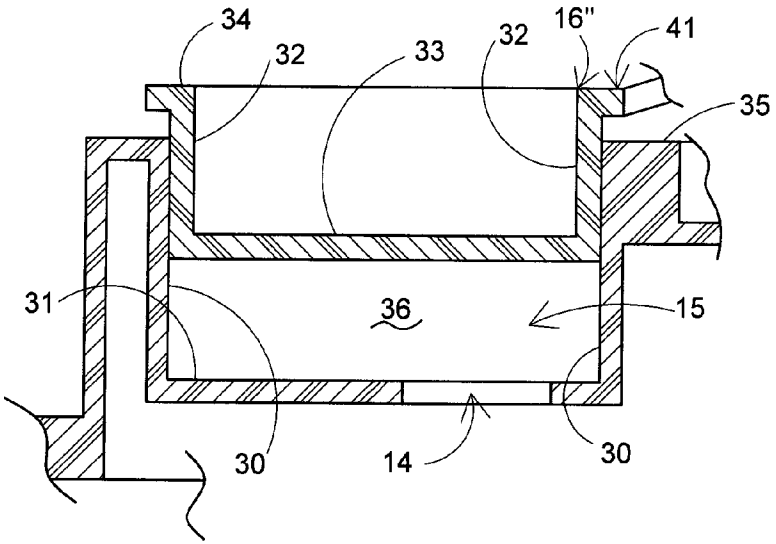
FIG. 14 is an enlarged schematic drawing of chamber 36 showing plug 16'' from the embodiment of FIG. 7, sectioned at line 14-14 of FIG. 7.

In another alternate embodiment, it is often desirable to releasably seal the drink opening. As shown in FIGS. 7 and 14, plug 16" does not have a fluid opening. Well 15 in this embodiment as in the other embodiments has a first fluid opening 14 to provide fluid communication to cup 23. Plug 16" in this embodiment being removable, is inserted into well 15 in the friction-fit/snap-fit relationship as previously described. Thus providing a leak-proof sealing arrangement for lid 10, when it is desired to have a cup lid 10 with such characteristics. In this embodiment, a user can insert plug 16" when it is desired to seal fluid opening 14, for example, to prevent any leaks or spills, or, to keep a beverage hot or cold, to close or cover the drinking hole opening 14. Then when the user desires to drink the fluid the plug 16" can be removed, while at the same time plug 16" remains connected to cup 10 by arms 17 and 18 in close proximity to lid 10, for insertion again into well 15 when desired.

Figure 11A:
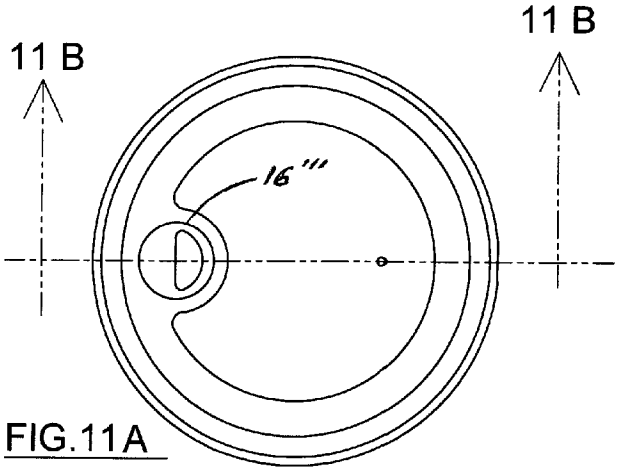
FIG. 11A is a top view of an alternative embodiement of the cup lid whereby plug 16''' has been detached from the cup lid and is placed within well 15.
Figure 11B:
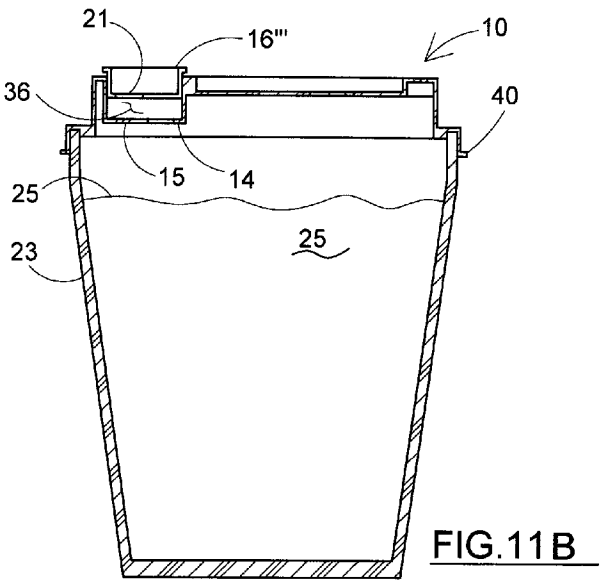
FIG. 11B is a sectional view along lines 11B-11B of FIG. 11A whereby plug 16''' has been detached from the cup lid and is placed within well 15.
Figure 10A:
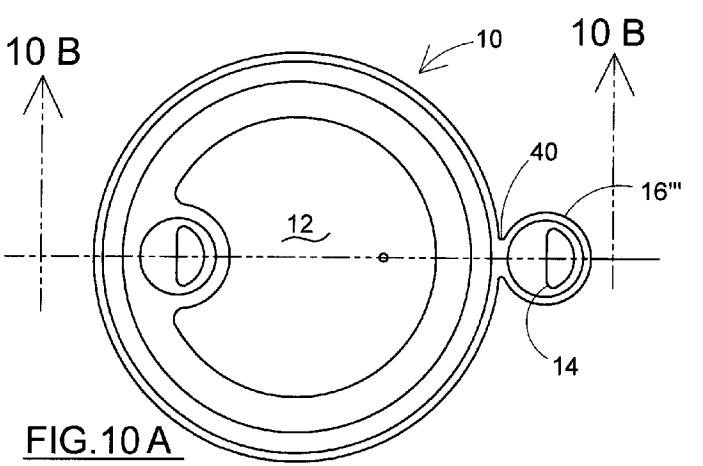
FIG. 10A is a top view showing another alternate embodiment whereby the closure means is detachable from the cup lid for placement directly within the well.
Figure 10B:
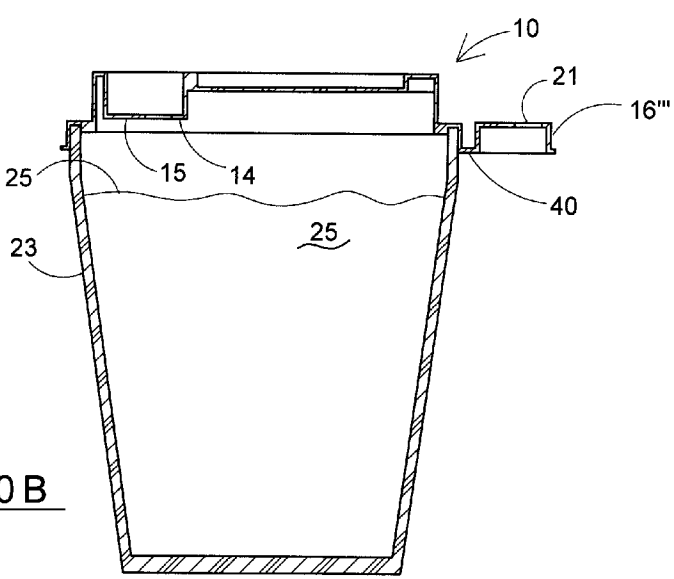
FIG. 10B is a side view taken from FIG. 10A along section lines 10B-10B.

In yet another embodiment, as shown in FIGS. 10 and 11, plug 16''' can be releasably attached to lid 10, such that it can be removed from lid 10 and placed into well 15 in a snap-fit, friction-fit relationship as previously described, but without arms 17 and 18. In this embodiment, plug 16''' is detachably connected to cup lid 10 by a breakable tab 40. When plug 16''' is removed from lid 10 it is placed and held in well 15 with a friction-fit as previously described. This allows drinking from the splash proof lid 10, as previously described where there is fluid communication from inside cup 23 through opening 14, chamber 36 and opening 21.

In addition, though wall 15 and plug 16 have been shown and depicted as round, it is also within the scope of this invention that the well and plug can be different shapes and sizes including oval, square, rectangular, kidney, etc.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A lid for attachment to a disposable drinking cup, the lid comprising:

a center portion having an opening formed therein;

a peripheral edge surrounding said center portion for engaging the drinking cup;

a plug disposed outside said peripheral edge and connected to said peripheral edge by two flexible support arms for allowing said plug to be repositioned at said opening, said support arms each having a respective first end affixed to said plug and a respective second end affixed to said peripheral edge, said plug configured for engaging said opening, said opening having a wall surrounding said opening, said wall projecting from said center portion, said plug having a plug wall configured for engaging said wall of said opening in a friction fit.

2. The lid according to claim 1, wherein said support arms each have a respective pinch point.

3. The lid according to claim 1, wherein said plug does not have an opening formed therein.

4. The lid according to claim 1, wherein said support arms each have a respective semi-circular profile matching said peripheral edge.

5. A lid for attachment to a disposable drinking cup, the lid comprising:

a center portion having a first surface;

a peripheral edge surrounding said center portion for engaging the drinking cup;

a second surface offset from said first surface, said second surface having an opening formed therein, and said second surface connected to said first surface by a wall surrounding said opening;

a plug disposed outside said peripheral edge and connected to said peripheral edge by two flexible support arms for allowing said plug to be repositioned at said second surface, said plug having a base, a plug wall, and an upper lip extending outwardly from said plug wall, said plug wall configured to engage said wall of said opening for defining a chamber between said base and said second surface when said upper lip is contacting said first surface.

6. The lid according to claim 5, wherein said wall of said opening engages said plug wall in a friction fit.

7. The lid according to claim 5, wherein said plug does not have an opening formed therein.

8. The lid according to claim 5, wherein said support arms each have a respective first end affixed to said plug and a respective second end affixed to said peripheral edge.

9. The lid according to claim 8, wherein said support arms each have a respective pinch point.

10. The lid according to claim 8, wherein said support arms each have a respective semi-circular profile matching said peripheral edge.

* * * * *